US006894016B2

(12) United States Patent
Ishikawa et al.

(10) Patent No.: US 6,894,016 B2
(45) Date of Patent: May 17, 2005

(54) LIQUID DETERGENT COMPOSITION

(75) Inventors: Akira Ishikawa, Wakayama (JP); Toshio Miyake, Wakayama (JP); Kazutoshi Ide, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/140,242

(22) Filed: May 8, 2002

(65) Prior Publication Data

US 2003/0013630 A1 Jan. 16, 2003

(30) Foreign Application Priority Data

May 8, 2001 (JP) ..... 2001-137791

(51) Int. Cl.[7] ..... C11D 1/72; C11D 3/04; C11D 3/43; C11D 3/37

(52) U.S. Cl. ..... 510/356; 510/303; 510/339; 510/342; 510/360; 510/413; 510/421; 510/466; 510/475; 510/507; 510/511; 510/531; 510/532

(58) Field of Search ..... 510/303, 339, 510/342, 356, 360, 413, 421, 466, 475, 507, 511, 531, 532

(56) References Cited

U.S. PATENT DOCUMENTS

| | | | | |
|---|---|---|---|---|
| 4,257,908 A | | 3/1981 | Wixon | |
| 6,344,434 B1 | * | 2/2002 | Matsuo et al. | 510/476 |
| 2003/0013630 A1 | * | 1/2003 | Ishikawa et al. | 510/475 |

FOREIGN PATENT DOCUMENTS

| | | | | |
|---|---|---|---|---|
| GB | 2 213 494 A | | 8/1989 | |
| GB | 2213494 | * | 8/1989 | C11D/1/74 |
| JP | 58145794 | | 8/1983 | |
| JP | 5-501574 | | 3/1993 | |
| JP | WO 97/38029 | * | 10/1997 | C08F/20/04 |
| JP | WO 97/38209 | * | 10/1997 | C08F/20/04 |
| JP | 11-279600 A | | 10/1999 | |
| JP | 2000-169878 A | | 6/2000 | |
| WO | WO 91/08280 | | 6/1991 | |
| WO | 91/08280 | | 6/1991 | |
| WO | 01/47808 | | 5/2001 | |

* cited by examiner

*Primary Examiner*—Brian P. Mruk
(74) *Attorney, Agent, or Firm*—Birch, Stewart, Kolasch & Birch, LLP

(57) ABSTRACT

To present a liquid detergent of a high cleaning power and an excellent storage stability while maintaining the ease of use. A liquid detergent composition comprising, at a specific ratio individually, (a) water, (b) a builder composed of a water-soluble inorganic salt of which solubility in distilled water is 0.5 g/15 g (25° C., distilled water) or more, and (c) a substance liquid at 25° C. containing at least one selected from the group consisting of surfactant (c1) and water-miscible organic solvent (c2) in which part of (b) is present in solid state in the composition, and its electric conductivity measured by a specific method is within a specified range.

9 Claims, No Drawings

LIQUID DETERGENT COMPOSITION

BACKGROUND OF THE INVENTION

1. Field of the Invention

The present invention relates to a liquid detergent composition having a low viscosity and a low spinnability, being ease to use and excellent in cleaning power.

2. Related Arts

A liquid detergent is easier to use than a powder detergent because it is dissolved completely and can be applied directly to the soil. Without being directly applied to the soil, the liquid detergent is often dissolved in washing water. In this case, the cleaning power of the liquid detergent tends to be inferior to that of the powder detergent. This is because a trouble occurs in stability of the system when a builder component such as an alkali agent or a Ca scavenger is incorporated so sufficiently in the composition as a powder detergent. From this viewpoint, liquid detergents blending builders have been developed. Japanese Patent Application Laid-open No. 58-145794 discloses an aqueous flowable detergent composition containing an effective dose of detergent builder that can be added by pouring. This is blended stably by suspending a builder in a liquid crystal forming structure, and has an aqueous continuous phase. However, since most of the compositions have a high viscosity of 1000 mPa·s or more, there were problems of liquid drips in adding, whereas compositions of relatively low viscosity are inferior in long-term storage stability. JP-A 5-501574, Japanese translation of PCT publication Laid-open, equivalent to WO91/08280, discloses a liquid detergent composition having lamellar liquid drops consisting of surfactant containing a deflocculating polymer of a special structure suspended in an aqueous continuous phase, and the viscosity of the composition ranges from 30 to 1750 mPa·s, but since the inorganic salt builder such as alkali agent is not contained more than the solubility in the aqueous continuous phase of the composition, the cleaning power was inferior.

SUMMARY OF THE INVENTION

It is hence an object of the invention to present a liquid detergent that is easy to use as a liquid detergent owing to low viscosity and low spinnability, is also capable of achieving a high cleaning power, and excellent in storage stability.

To achieve the object, the invention relates to a liquid detergent composition comprising (a) 3 to 15 mass % of water [hereinafter called component (a)], (b) 0.5 to 50 mass % of a builder composed of a water-soluble inorganic salt of which solubility in distilled water is 0.5 g/15 g (25° C., distilled water) or more [hereinafter called component (b)], and (c) a substance liquid at 25° C. [hereinafter called component (c)] comprising at least one selected from the group consisting of a surfactant (c1) [hereafter called component (c1)] and a water-miscible organic solvent (c2) [hereinafter called component (c2)], in which part of (b) is present in the solid state in the composition, and the following formula (1) is satisfied:

$$\sigma 2/\sigma 1 \geqq 10 \quad (1)$$

wherein σ1 is the electric conductivity (S/cm, 25° C.) of the liquid detergent composition, and σ2 is the electric conductivity (S/cm, 25° C.) of an aqueous solution of which the concentration of the total water-soluble inorganic salt in the composition including (b) is 3.22 mass %.

DESCRIPTION OF THE PREFERRED EMBODIMENTS

<Component (a)>

Water as component (a) may be distilled water, deionized water, or tap water, and when using tap water, soft water is preferred, and in particular the lower the contents of alkali metal ions, alkaline earth metal ions, group III metal ions, and transition metal ions in the component (a), the better it is. Water contained as water of crystallization in inorganic salt or the like in the composition is removed from component (a), and is not counted in the mass of component (a). From the viewpoints of low temperature stability, long-term storage stability, and application cleaning power of the composition, the content of component (a) is 3 to 15 mass % in the composition, preferably 3 to 13 mass %, more preferably 3 to 11 mass %, or most preferably 3 to 9 mass %.

<Component (b)>

The composition of the invention contains a builder composed of a water-soluble inorganic salt as component (b) by 0.5 to 50 mass %, preferably 1 to 40 mass %, or more preferably 5 to 30 mass %. Herein, the water-soluble inorganic salt is an inorganic salt of which solubility in distilled water is 0.5 g/15 g (25° C., distilled water) or more. This content is the total amount of component (b) including the portion of component (b) dissolved in component (a) and other liquid components in the composition, and for example when part of component (b) is dissolved in component (a), this amount is counted in the mass of component (b).

Examples of component (b) include one or more of sodium chloride, potassium chloride, sodium sulfate, potassium sulfate, sodium sulfite, potassium sulfite, sodium hydrogensulfite, ammonium chloride, ammonium sulfate, sodium carbonate, potassium carbonate, sodium hydrogencarbonate, sodium silicate (1), sodium silicate (2), sodium silicate (3), sodium tetraborate, sodium pyrophosphate, sodium tripolyphosphate, sodium hydroxide, and potassium hydroxide. Among them, one or more selected from sodium sulfite, potassium sulfite, sodium carbonate, potassium carbonate, sodium hydrogencarbonate, sodium silicate (1), sodium silicate (2), sodium silicate (3), sodium tetraborate, sodium pyrophosphate, sodium tripolyphosphate, sodium hydroxide, and potassium hydroxide are preferred from the viewpoint of cleaning power. In the water-soluble inorganic salts showing the pH of 10 or more (25° C., electrode method) in an aqueous solution having 0.5 g as the anhydride dissolved in 15 g of distilled water, in particular, sodium carbonate, potassium carbonate, sodium pyrophophate, sodium tripolyphosphate, sodium hydroxide and potassium hydroxide, sodium silicate (1), sodium silicate (2) and sodium silicate (3) are preferred in the aspect of application cleaning power. Further, compounds excellent in alkali buffer capability per unit mass in the pH range of 8 to 12 are preferred, that is, supposing the pH value (25° C., electrode method) of the compound in 0.025 mass % aqueous solution (distilled water) to be Pi, a compound having Pi of 9 or more and the dropping amount of hydrochloric acid of 3 mL or more until the pH value of the aqueous solution reaches (Pi−1) by dropping 0.1 normal hydrochloric acid in the aqueous solution is preferred, and as the compound having such buffer capability, one or more selected from sodium carbonate, potassium carbonate, sodium silicate (1), sodium pyrophosphate, and sodium tripolyphosphate are preferred for enhancing the cleaning power. Further, sodium carbonate is most preferred from the viewpoint of economy.

The component (b) is blended so that the composition of the liquid detergent may satisfy formula (1), preferably $\sigma2/\sigma1 \geqq 20$, more preferably, $\sigma2/\sigma1 \geqq 40$.

This formula (1) is a parameter showing the degree of presence of water, that is, component (a) in the composition as a discontinuous phase.

Specifically, $\sigma1$ is the electric conductivity (S/cm, 25° C.) of the liquid detergent composition itself, and $\sigma2$ is the electric conductivity (S/cm, 25° C.) of total water-soluble inorganic salt contained in the liquid detergent composition [total of component (b) and arbitrary water-soluble inorganic salt other than component (b)] by preparing an aqueous solution separately, and adjusting its concentration to $0.5/(15+0.5)\times100$ (mass %), that is, 3.22 mass %.

Herein, the water-soluble inorganic salt other than component (b) is an inorganic salt of which solubility in distilled water is 0.5 g/15 g (25° C., distilled water), but it does not function as builder.

When satisfying the condition of $\sigma2/\sigma1 \geqq 10$, component (a) in the liquid detergent composition, that is, water exists as a discontinuous phase, and the ratio of component (b) existing in the continuous phase of component (c) in the composition by ionic dissociation is considered to be low. Accordingly, ion-ion interaction is weak, and even if a large amount of component (b) is blended in the composition, part of it exists in macro solid state, and viscous solution like thick electrolyte aqueous solution is not formed, and an easy-to-use viscosity may be maintained. For the purpose of enhancing the cleaning power, if component (b) is blended more, when the composition of the invention is poured into the washing water, component (b) is dissolved promptly, and a detergent of high quality is obtained. In the invention, to measure the electric conductivity, for example, an electric conductivity meter CM-605 (electrode method) of DKK-TOA Corporation is used.

The method of determining the blending ratio (mass %) of component (b) for satisfying $\sigma2/\sigma1 \geqq 10$ is as follows as far as the content of water-soluble inorganic salt other than component (b) is as small as ignorable.

First, the composition of component (b) to be blended in the liquid detergent composition is determined arbitrarily (hereinafter this composition is called composition b1). Component (b) of composition b1 is added in excess in distilled water at 25° C. until solid matter is not dissolved but left over, and let stand still in an enclosed container for 24 hours at constant temperature of 25° C. Then the residual solid matter not dissolved in solution (if residual solid has been lost, component (b) of composition b1 is further added and the same operation is repeated) is filtered through a membrane filter of 0.2 μm, and saturated aqueous solution of component (b) of composition b1 is obtained (25° C., distilled water). This saturated aqueous solution is symbolized as b1satrd.aqua. Next, the composition of component (c) to be blended in the liquid detergent composition is determined arbitrarily (hereinafter this composition is called composition c1). Component (b) of composition b1 is added in excess to the component (c) of composition c1 at 25° C. until solid matter is not dissolved but left over, and let stand still in an enclosed container for 24 hours at constant temperature of 25° C. Then the residual solid matter not dissolved in solution (if residual solid has been lost, component (b) of composition b1 is further added and the same operation is repeated) is filtered through a membrane filter of 0.2 μm, and saturated solution of component (b) of composition b1 is obtained (25° C., component (c) solution of composition c1). This saturated aqueous solution is symbolized as b1 satrd.cl. The content ratio (mass %) of component (b) in b1satrd.saqua and b1 satrd.cl is determined by a proper method, for example, subtracting the mass of component (b) being filtered from the mass of component (b) being added, or by measuring the mass of the ash content in the solution, and rb1saq (mass %) and rb1scl (mass %) are obtained respectively. Preparing 50 g of b1 satrd.cl obtained by this operation, 0.5 g each of b1satrd.aqua is added to b1satrd.cl while measuring the electric conductivity at constant temperature of 25° C., and the measured value is recorded in correspondence to the added amount β (g) of b1satrd.aqua, and it is obtained as σb1cl (β). This operation is continued until the added amount of b1satrd.aqua reaches a total of 50 g. Then, preparing 50 g of distilled water aqueous solution containing component (b) of composition b1 at a ratio (mass %) of rb1sc1, 0.5 g each of b1satrd.aqua is added while measuring the electric conductivity at constant temperature of 25° C., and the measured value is recorded in correspondence to the added amount β (g) of b1satrd.aqua, and it is obtained as σb1aqua (β). This operation is continued until the added amount of b1satrd.aqua reaches a total of 50 g. Concerning the same value of β, the value of β is (if plural) is recorded in all cases when the value of σb1aqua (β)÷σb1cl (β) exceeds 10. In each β value at this time, a mixture (Mix (β)) of β (g) of b1satrd.aqua and 50 g of b1 satrd.cl is prepared, and the ratio (mass %) of all component (b) in the mixture (Mix (β)) is calculated by using the values of rb1saq and rb1sc1 [the added amount of b1satrd.aqua is β (g), b1 satrd.cl is 50 g, and the composition amount of β (g)+50 g], and this value is supposed to be b3 (mass %). When the value of β is present in a plurality, there are also plural values of b3, and the smallest value of b3 is supposed to be b3min (mass %).

That is, concerning component (b) of composition b1 preliminarily set arbitrarily and component (c) of composition c1 similarly set arbitrarily, when the blending ratio of component (b) is determined so as to establish formula (1), it is one of the hints to contain component (b) by b3 or b3min (mass %) or more as determined by the above method in the composition.

All inorganic salts in the liquid detergent composition of the invention are preferred to be water-soluble inorganic salts, and all water-soluble inorganic salts are preferred to be builder, that is, component (b)

Part of component (b) exists in solid state in the composition, but the "mean particle size" of component (b) existing in solid state in the composition is preferably 1 μm or less from the viewpoint of prevention of separation, more preferably 0.8 μm or less, and most preferably 0.5 μm or less. Herein, the "mean particle size" is the median diameter calculated by reference to the volume. The particle size is measured, for example, by laser diffraction type particle size distribution measuring instrument (model LA-920 of Horiba, Ltd.).

The solid of the component (b) is present preferably in the amount of 0.1 to 99.99 mass % per the total component (b), more preferably 1 to 99.95 mass %, much more preferably 10 to 99.9 mass %, from the viewpoint of easy treatment by a low viscosity <Component (c)>

The composition of the invention contains component (c) by, preferably, 5 to 96.5 mass %, more preferably 10 to 90 mass %, further preferably 20 to 85 mass %, and particularly preferably 30 to 80 mass %. Component (c) is composed of surfactant (c1), and water-miscible organic solvent (c2), or their mixture, and the entire component (c) is liquid at 25° C. As component (c), it is preferred to contain polyalkyleneglycol alkyl ether.

Component (c1) is preferred to occupy by 5 to 95 mass % in component (c), more preferably 10 to 90 mass %, further preferably 25 to 85 mass %, and particularly preferably 40 to 80 mass %.

As the component, a nonionic surfactant and an anionic surfactant are preferred, and above all, in particular, a nonionic surfactant is preferred, and preferred examples include aliphatic alcohol having alkyl group with 8 to 20 carbon atoms, fatty acid and fatty acid alkylester having alkyl group with 9 to 21 carbon atoms, or aliphatic and the like amine having alkyl group with 8 to 20 carbon atoms, combined with ethylene oxide (EO), or propylene oxide (PO), those having sugar-derivative polyol as hydroxyl group, amine oxide, and fatty acid amide.

As the nonionic surfactant, those expressed in formula (2) and/or (3) are preferred, and in particular the compound expressed in formula (3) is preferred because of ease of pouring of liquid detergent composition.

$$R^1O(EO)_mH \quad (2)$$

where $R^1$ is an alkyl group and/or alkenyl group of 8 to 20 carbon atoms in average, or preferably 10 to 18, being a residue excluding hydroxyl group from primary and/or secondary alcohol, EO is an ethyleneoxy group, and m is the mean showing a number of 5 to 20.

$$R^2O(EO)_k/(PO)_1H \quad (3)$$

wherein $R^2$ is an alkyl group and/or alkenyl group of 8 to 20 carbon atoms in average, or preferably 10 to 18, being a residue excluding hydroxyl group from primary and/or secondary alcohol, EO is an ethyleneoxy group, PO is a propyleneoxy group, k is the mean value showing a number of 5 to 15, and 1 is the mean value showing a number of 1 to 5, and meanwhile EO and PO may be any one of random addition, block addition of PO after addition of EO, or inverse block addition.

In particular, by using a nonionic surfactant expressed in formula (4), a high cleaning power of collar and sleeve can be obtained.

$$R^3O(EO)_p(PO)_q(EO)_rH \quad (4)$$

wherein $R^3$ is an alkyl group and/or alkenyl group of 8 to 20 carbon atoms in average, or preferably 10 to 18, being a residue excluding hydroxyl group from primary and/or secondary alcohol, EO and PO are the same as defined above, and p, q, r are average addition molar numbers, specifically p>0, q=1 to 4, r>0, p+q+r=6 to 14, p+r=5 to 12, and preferably, p+q+r=7 to 14, p+r=6 to 12, and q=1 to 2.

In formulae (2), (3), and (4), $R^1$, $R^2$, and $R^3$ may be alkyl groups and/or alkenyl groups derived from natural fats and oils.

As the nonionic surfactant, further, an alkyl polysaccharide surfactant expressed in formula (5) may be also used.

$$R^4—(OR^5)_xGy \quad (5)$$

wherein $R^4$ is an alkyl group, alkenyl group, or alkylphenyl group with 8 to 18 carbon atoms of straight or branched chain, $R^5$ is an alkylene group with 2 to 4 carbon atoms, G is a residue of 5 or 6 carbon atoms derived from reducing sugar, x is the mean value showing a number of 0 to 6, and y is the mean value showing a number of 1 to 10.

In addition, amine oxide expressed in formula (6) may be also used.

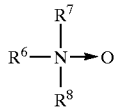

(6)

wherein $R^6$ is an alkyl group and/or alkenyl group of 8 to 20 carbon atoms in average, or preferably 10 to 18, being a residue excluding hydroxyl group from primary and/or secondary alcohol, or a compound expressed by $R^9C(=O)NH(CH_2)_z$— where $R^9$ is an alkyl group and/or alkenyl group of 8 to 20 carbon atoms in average, or preferably 12 to 18, and z is an integer ranging from 1 to 5, and $R^7$ and $R^8$ may be either same or different, representing $CH_3$, $C_2H_5$, or $C_2H_4OH$.

Furthermore, fatty acid alkanolamide, polyhydroxy fatty acid amide, and others may be blended.

The ratio of the nonionic surfactant is preferred to be 10 to 90 mass % of the entire component (c), more preferably 25 to 85 mass %, and most preferably 40 to 80 mass %.

Component (c1) may contain other surfactant than the nonionic surfactant, but the nonionic surfactant should occupy preferably 20 to 100 mass % in component (c1), more preferably 30 to 100 mass %, or particularly 40 to 100 mass %. Other surfactant s than the nonionic surfactant may include anionic surfactant, cationic surfactant, and amphoteric surfactant.

As the anionic surfactant, the following examples (a) to (d) may be used.

(a) Alkylbenzene sulfonate having alkyl group of 10 to 20 carbon atoms on the average.

(b) Alkylalkoxy sulfate salt, having an alkyl group derived from a straight chain primary alcohol or straight chain secondary alcohol or an alkyl group derived from a branched chain alcohol of 10 to 20 carbon atoms on the average, and containing an average of 0.5 to 6 moles of EO in one molecule.

(c) Alkyl or alkenyl sulfate ester salt, having an alkyl or alkenyl group of 10 to 20 carbon atoms on the average.

(d) Fatty acid salt of 8 to 20 carbon atoms in average.

Counter ions of these anionic surfactants may be selected from the group consisting of cations of sodium, potassium, magnesium, calcium, alkanolamine, and others, or their mixtures. Further, monomethyl diethanolamine, or dimethyl monoethanolamine may be used. When blending an anionic surfactant, it may be blended in the detergent composition in an acid form, or may be neutralized by alkali agent such as sodium carbonate or monoethanolamine separately added in the composition.

The ratio of the anionic surfactant is preferably 30 mass % or less (including 0 mass %) in component (c), and more preferably 20 mass % or less (including 0 mass %). In component (c1), it is preferred to be 0 to 40 mass %, further preferably 0 to 20 mass %, and most preferably 0 to 10 mass %.

As the cationic surfactant, the cationic surfactant expressed in formula (7) is preferred.

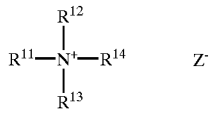

(7)

wherein $R^{11}$ is an alkyl, alkenyl or hydroxyalkyl group of 8 to 20 carbon atoms on the average, preferably 12 to 18, or a group having an ester or amide group derived from a fatty acid, having 8 to 20 carbon atoms on the average, preferably 12 to 18; $R^{12}$ is the same group as $R^{11}$ or a hydrogen atom or an alkyl, preferably methyl group, or hydroxyalkyl group of 1 to 3 carbon atoms; if both $R^{11}$ and $R^{12}$ are groups of 8 or more carbon atoms, the preferred number of carbon atoms on the average is 8 to 12 individually; $R^{13}$ and $R^{14}$ are the same or different, that is, hydrogen atom, an alkyl, preferably methyl group, or hydroxyalkyl group of 1 to 3 carbon atoms or benzyl group; and $Z^-$ is an anion, preferably halogen ion, or sulfonic acid ion of total number carbon atoms of 1 to 3, or more preferably chloride ion or methyl sulfonic acid ion.

The ratio of the cationic surfactant is preferably 20 mass % or less (including 0 mass %) in component (c), and more preferably 10 mass % or less (including 0 mass %) In component (c1), it is preferred to be 0 to 30 mass %, further preferably 0 to 20 mass %, and most preferably 0 to 10 mass %.

As the amphoteric surfactant, alkylcarbobetaine, alkylsulfobetaine, alkylamide hydroxysulfobetaine, alkylamide-amine type betaine, or alkylimidazoline type betaine can be blended.

The ratio of the amphoteric surfactant is preferably 20 mass % or less (including 0 mass %) in component (c), and more preferably 10 mass % or less (including 0 mass %). In component (c1), it is preferred to be 0 to 30 mass %, further preferably 0 to 10 mass %, and most preferably 0 to 5 mass %.

In this invention, a surfactant being solid at 25° C. can be used as a constituent part of the component (c) by being made soluble with the water-miscible organic solvent of the component (c2), a surfactant of the component (c1) being liquid at 25° C. or the like. So far as the effect of the invention is not sacrificed, part of the surfactant which is in solid state at 25° C. may be present in solid state in the composition, but since such solid surfactant is not constituent part of component (c), it is not counted as component (c1).

In the invention, as component (c), a water-miscible organic solvent of component (c2) may be also used. The ratio of component (c2) is preferably 5 to 95 mass % in component (c), more preferably 10 to 90 mass %, further preferably 15 to 80 mass %, and particularly preferably 20 to 70 mass %. As component (c2), a water-miscible organic solvent having a hydroxy group and/or an ether group is preferred. The following list shows examples of component (c2), and one or more thereof may be preferably used.

(i) Alkanols including ethanol, 1-propanol, 2-propanol, and 1-butanol, (ii) glycols including propylene glycol, butylene glycol, and hexylene glycol, (iii) polyglycols including diethylene glycol, triethylene glycol, tetraethylene glycol, polyethylene glycol of the average molecular weight of about 200, polyethylene glycol of the average molecular weight of about 400, dipropylene glycol, tripropylene glycol, and polypropylene glycol of average molecular weight of about 2000, (iv) alkylethers including diethylene glycol monomethylether, diethylene glycol dimethylether, triethylene glycol monomethylether, diethylene glycol monoethylether, diethylene glycol diethylether, dipropylene glycol monomethylether, dipropylene glycol monoethylether, tripropylene glycol monomethylether, 1-methoxy-2-propanol, 1-ethoxy-2-propanol, 1-methylglycerinether, 2-methylglycerinether, 1,3-dimethylglycerinether, 1-ethylglycerinether, 1,3-diethylglycerinether, triethylglycerinether, 1-pentylglycerylether, 2-pentylglycerylether, 1-octylglycerylether, 2-ethylhexylglycerylether, and diethylene glycol monobutylether, (v) aromatic ethers including 2-phenoxyethanol, diethylene glycol monophenylether, triethylene glycol monophenylether, polyethylene glycol monophenylether of average molecular weight of about 480, 2-benzyloxyethanol, and diethylene glycol monobenzylether, and (vi) alkanolamines including 2-aminoethanol, N-methylethanolamine, N,N-dimethylethanolamine, N,N-diethylethanolamine, diethanolamine, N-methyldiethanolamine, N-butyldiethanolamine, triethanolamine, triisopropanolamine, and isopropanolamine mixtures (mono, di, tri mixtures).

Component (c2) is effective as viscosity regulator and gelation suppressor of the composition, and it is preferred to combine two types or more selected from the above list of (i) alkanols, (ii) glycols, (iv) alkylethers, and (v) aromatic ethers, and more preferably two or more selected from (ii), (iv), and (v), and particularly preferably two or more selected from (ii) and (v), so that the viscosity regulation and gelation suppression of the composition may be achieved effectively.

So far as the effect of component (c2) is not sacrificed, a water-immiscible organic solvent may be used. Such organic solvents include paraffins such as octane, decane, dodecane, and tridecane, olefins such as decene and dodecene, halogenated alkyls such as methylene chloride and 1,1,1-trichloroethane, and terpenes such as D-limonene. The ratio of the water-immiscible organic solvent is 20 mass % or less (including 0 mass %) in component (c), or preferably 0 to 10 mass % (including 0 mass %).

In the invention, preferably, component (c) should be selected so that the mixture of total amount of component (c)/component (a)=80/20 (ratio by mass) maybe an optically isotropic uniform liquid at 5° C., and it is more preferable to select component (c) so that the mixture of total amount of component (c)/component (a)=60/40 (ratio by mass) may be an optically isotropic uniform liquid at 5° C. The ratio by mass of component (c1) and component (c2) is preferably (c1)/(c2)=5/95 to 95/5, more preferably 10/90 to 90/10, further preferably 25/75 to 85/15, and particularly preferably 40/60 to 80/20.

<Component (d)>

The composition of the invention preferably comprises a builder composed of (d) water-insoluble compound, at least partly existing in solid state in the composition (hereinafter called component (d)). As component (d), a compound of which solubility in distilled water at 25° C. is 0.1 mass % or less may be blended. The content of component (d) in the composition is preferably 0.5 to 50 mass %, more preferably 1 to 45 mass %, further preferably 5 to 40 mass %, and particularly preferably 10 to 40 mass %.

As component (d), preferably, a wide variety of aluminosilicates expressed in formula (8) may be blended.

$$[M(1)_pM(2)_qM(3)_rO]\cdot u[M(4)_sM(5)_tO]\cdot v(Al_2O_3)\cdot w(SiO_2) \quad (8)$$

wherein M(1), M(2), and M(3) represent Na, K, and H respectively, M(4) and M(5) represent Ca and Mg respectively, p, q, r range from 0 to 2 (however, p+q+r=2), s, t are 0 to 1 (however, s+t=1), u is 0 to 1, preferably 0.1 to 0.5, v is 0 to 1, preferably 0 to 0.1, and w is 0 to 0.6, preferably 0.1 to 0.5.

Such aluminosilicates include various zeolites used generally as detergents. They are classified into A type, X type, Y type, and P type according to the crystal system, and generally the A type zeolite is preferred because it is excellent in cation exchange capability. The A type zeolite shows the X-ray diffraction pattern having the diffraction peak at the position indicated by 4A type zeolite (No. 38–241) proposed by JCPDS (Joint Committee on Powder Diffraction Standards). A commercial example of such zeolite is Toyo Builder of Toyo Soda Manufacturing Co., Ltd. Further, in the manufacturing process of the detergent composition of the invention, from the viewpoint of ease of grinding and enhancement of dispersion stability, it is also preferred to use a fine granular zeolite manufactured in the method proposed in JP-A 2001-139322, published on May 22, 2001. The content of the aluminosilicates of (d) is preferably 20 to 100 mass %, more preferably 40 to 100 mass %, and most preferably 60 to 100 mass %.

Preferably, the "mean particle size" of component (d) existing in solid state is 1 μm or less from the viewpoint of prevention of separation, and more preferably 0.8 μm or less, and particularly preferably 0.5 μm or less. Herein, the "mean particle size" is the median diameter calculated by reference to the volume. The particle size is measured, for example, by laser diffraction type particle size distribution measuring instrument (model LA-920 of Horiba, Ltd.).

Such aluminosilicates having "the mean particle size" can be obtained by grinding the above zeolite. The wet or dry grinding method can be used. The wet grinding is preferred from the viewpoint of maintenance of the cation exchange capacity. When the liquid detergent composition of the invention may be prepared by grinding the alminosilicate and incorporating a given amount of it as the component (d). It may be ground together with a mixture containing all or parts of the components (a)~(c). Grinding the aluminosilicate may sometimes liberate aluminum, being the element of the aluminosilicate, in the form of an aluminate. The content of the free aluminate is preferably 2000 mass ppm or less in the liquid detergent composition of the invention, more preferably 1000 mass ppm or less, much more preferably 800 mass ppm or less. The amount of the free alminate may almost depend on the mean primary particle size of the starting aluminosilicate. The smaller the mean primary particle size of the starting aluminosilicate, without grinding yet, is, the less the amount of the free aluminate is after grinding. For this reason the mean primary particle size of the alminosilicate before grinding is preferably 2 ìm or less, more preferably 1 ìm or less, further preferably 0.5 ìm or less, particularly preferably 0.1 ìm or less.

The mean primary particle size can be determined by selecting 50 or more particles at random as the primary particle in an SEM-photograph taken by scanning an electron microscope(Shimadzu SUPERSCAN-220) at 5000 magnification and measuring the maximum widths of the primary particles, respectively, with a digitizer (DIGITIZER KW3300 of Graftic Co., Ltd.), followed by calculating the average value of the measured values as the mean primary particle size of them.

The viscosity (20° C.) of the liquid detergent composition of the invention is preferably 10 to 2500 mPa·s from the viewpoint of ease of use, more preferably 50 to 2000 mPa·s, and particularly 100 to 1500 mPa·s. The viscosity is measured by type B viscometer (model DVM-B of Tokyo Keiki), using three or four rotors, in the condition of rotating speed of 60 r/min and measuring time of 60 seconds.

<Polymer Type Dispersant>

In the liquid detergent composition of the invention, it is preferred to use a polymer type dispersant in order to enhance the phase stability. The polymer type dispersant disperses the solid matter in the composition uniformly, and the volume fraction of the separation layer of one-month storage after dispersion operation should be 5% or less. In particular, it is preferably obtained by polymerization or polycondensation of one or more monomers selected from the monomer group for composing a polymer having solubility or uniform dispersion in the liquid phase containing component (a) and component (c), and the monomer group having a functional group of high affinity for component (d), in particular, aluminosilicate.

Examples of the monomer group for composing a polymer having solubility or uniform dispersion in the liquid phase include (i) to (q) as given below.

(i) Vinylethers having a non-substituted or substituted and saturated or unsaturated alkyl or aralkyl group of 1 to 22 carbon atoms. For example, methylvinylether, ethylvinylether, 4-hydroxy butylvinyl ether, and phenylvinylether are preferred.

(j) Non-substituted or substituted (meth)acrylamides having saturated or unsaturated alkyl group or aralkyl group of 1 to 12 carbon atoms on nitrogen. For example, (meth) acrylamide, N-methyl(meth)acrylamide, N,N-dimethyl (meth)acrylamide, N-ethyl(meth)acrylamide, N-t-butyl (meth)acrylamide, (meth)acryloylmorpholine, 2-(N, N-dimethylamino) ethyl(meth)acrylamide, 3-(N, N-dimethylamino)propyl(meth)acrylamide, 2-hydroxyethyl (meth)acrylamide, N-methylol (meth) acrylamide, and N-butoxymethyl(meth)acrylamide are preferred.

(k) N-vinyl aliphatic amides. For example, N-vinylpyrrolidone, N-vinylacetamide, and N-vinylformamide are preferred.

(1) (Meth)acrylate esters having a non-substituted or substituted and saturated or unsaturated alkyl or aralkyl group of 1 to 22 carbon atoms. For example, methyl (meth) acrylate, ethyl(meth)acrylate, 2-hydroxyethyl (meth) acrylate, 2-(N,N-dimethylamino)ethyl (meth)acrylate, 2-methoxyethyl (meth)acrylate are preferred.

(m) Alkylene oxides. For example, ethylene oxide and propylene oxide are preferred.

(n) Cyclic iminoethers. For example, 2-methyl-2-oxazoline and 2-phenyl-2-oxazoline are preferred.

(o) Styrenes. For example, styrene, 4-ethylstyrene, and α-methylstyrene are preferred.

(p) Vinylesters. For example, vinyl acetate and vinyl caproate are preferred.

(q) Allyl ethers having a non-substituted or substituted and saturated or unsaturated alkyl or aralkyl group of 1 to 22 carbon atoms. For example, methylallyl ether, ethylallyl ether, 4-hydroxybutylallyl ether, and phenylallyl ether are preferred.

Besides the polymers obtained from these monomer groups, polymers dissolving or uniformly dispersing in liquid phase include the following structures (r) to (t) and polymers composed of these structures and one or more type of monomer groups having a functional group of high affinity for solid component described below may be also preferred.

(r) Polyesters composed of bihydric alcohol and bibasic carboxylic acid. For example, polycondensates of polyethylene glycol and terephthalic acid, or 1,4-butanediol and succinic acid are preferred.

(s) Polyamides. For example, a polymer obtained by ring-polymerization of N-methyl valerolactam is preferred.

(t) Polyurethanes. For example, polyaddition compounds of polyethylene glycol and hexamethylene diisocyanate and N-methyl diethanolamine or 1,4-butane diol are preferred.

Preferred functional groups having high affinity for component (d), in particular, aluminosilicate include carboxyl group, sulfonic group, hydroxyl group, and primary to quaternary ammonium group. Monomers having such functional groups include (meth) acrylic acid and its salts, styrene carboxylic acid and its salts, maleic acid and its salts, itaconic acid and its salts, styrene sulfonic acid and its salts, (meth)allyl sulfonic acid and its salts, 2-acrylamide-2-methylpropane sulfonic acid and its salts, vinyl sulfonic acid and its salts, vinyl alcohol, 2-hydroxyethyl (meth)acrylate, 2-hydroxyethy (meth)acrylamide, 4-hydroxymethylstyrene, mono-2-((meth) -acryloyloxy)ethyl phosphate, 2-((meth) acryloyloxy)ethyltrimethyl ammonium chloride, vinylbenzyltrimethyl ammonium chloride, 2-((meth) acryloyloxy) ethyldimethylammonium ethylsulfate, 3-((meth) acrylamide)propyltrimethylammonium chloride, diallyldimethylammonium chloride, and vinylpyridine.

Among them, the particularly preferred polymer dispersant is a block or graft polymer of a polymer having solubility or uniform dispersibility in liquid phase, and a polymer having a functional group of high affinity for component (d), especially aluminosilicate.

Since two kinds of segments are present, the both effects are exhibited without canceling each other. To realize the both effects more highly, it is particularly preferred to use a graft polymer. The ratio by mass of two segments in the block or graft polymer [(polymer segment soluble or uniformly dispersible in liquid phase)/(polymer segment having functional group of high affinity for solid component)] is preferred to be 5/95 to 95/5. The synthetic method of such block or graft polymer preferably includes, for example, a method of polymerizing a vinyl monomer or the like by using a macro azo initiator having an azo group in the polymer chain (macro azo initiator method), a method of using a compound having a polymerizable group at one end of polymer chain (macro monomer method), and a method of radically polymerizing a monomer in the presence of a polymer, and linking the newly produced polymer chain to the coexisting preliminary formed polymer chain by chain transfer reaction (chain transfer method). Examples of polymer type dispersant obtained by these methods include a block polymer obtained by radical polymerization of acrylic acid (or its salt) by using polyethylene glycol macro azo initiator, a copolymer of polyethylene glycol mono(meth) acrylic acid ester and (meth)acrylic acid ester or its salt, a copolymer of polyethylene glycol mono(meth)acrylic acid ester and styrene sulfonic acid ester or its salt, a copolymer of polyethylene glycol mono(meth)acrylic acid ester and 2-((meth) acryloyloxy)ethyltrimethylammonium chloride, a copolymer of polyethylene glycol mono(meth)acrylic acid ester and 2-hydroxyethyl (meth)acrylate, a graft polymer obtained by radical polymerization of acrylic acid and maleic acid (or its salt) in polyethylene glycol or polypropylene glycol or polyethylene glycol propylene glycol, a graft polymer obtained by radical polymerization of diallyl dimethyl ammonium chloride in poly(N,N-dimethyl (meth) acrylamide/styrene) copolymer aqueous solution, and a graft polymer obtained by radical polymerization of styrene sulfonic acid (or its salt) in poly(N,N-dimethyl(meth) acrylamide) aqueous solution. The weight-average molecular weight of these polymer type dispersants is preferred to be 1,000,000 or less in order to prevent excessive elevation of viscosity, preferably 1,000 to 500,000, or more preferably 10,000 to 300,000.

In the invention, the content of the polymer type dispersant in the composition is preferably 0.05 to 20 mass %, more preferably 0.1 to 10 mass %, and particularly preferably 0.5 to 5 mass %.

The pH (25° C.) of the liquid detergent composition of the invention is preferred to be 9 to 14, preferably 9 to 13, more preferably 9 to 12, from the viewpoint of application cleaning performance. Also from the viewpoint of cleaning performance in ordinary use, when the composition is diluted in deionized water by 1500 times by reference to the mass, the pH (25° C.) is preferred to be 9 to 11. Herein, the pH is measured according to JIS Z 8802. The measuring apparatus is, for example, a glass electrode type pH meter (model D-14 of Horiba, Ltd.).

<Enzyme>

The composition of the invention is preferred to contain an enzyme from the viewpoint of enhancing the cleaning power. As the enzyme, protease, cellulase, lipase or amylase may be blended, and when an enzyme is contained in the liquid detergent, unlike the case of powder detergent, since it is likely to have an effect of impeding substance such as surfactant, it is selected by investigating the stability in the presence of substance considered to be an impeding substance in the detergent, and stability in actual detergent.

The enzyme is blended, as the enzyme bulk powder from the viewpoint of application cleaning power, in particular, preferably by 0.002 to 5 mass % in the composition, more preferably 0.005 to 3 mass %, or most preferably 0.01 to 2 mass %.

<Others>

The composition may further comprise arbitrary components, including a solubilizer such as p-toluene sulfonic acid, or benzoate (also effective as preservative); aminopolyacetates as polycarboxylate having bivalent metal ion binding capability such as nitrilotriacetate, ethylenediamine tetracetate, iminodiacetate, diethylenetriamine pentacetate, glycoletherdiamine tetracetate, hydroxyethyl iminodiacetate, or triethylene tetramine hexacetate; salt of malonic acid, succinic acid, diglycolic acid, malic acid, tartaric acid, or citric acid; dye transfer preventive agent such as polyvinyl pyrrolidone; enzyme stabilizer such as calcium chloride, calcium sulfate, formic acid, or boric acid (boron compound); fluorescent whitening agent such as Tinopal CBS-X (trade name of Ciba Specialty Chemicals); silicone for flexibility additive; silica or silicone as defoaming agent; antioxidant such as butylhydroxytoluene or distyrenated cresol; other; blueing agent; perfume; and antibacterial preservative.

The term "liquid" in the invention refers to be flowable at 25° C. Whether flowable or not is defined as follows. A cylindrical glass container is prepared, which is 30 mm in inside diameter and 50 mm in height, and is opened at one of two cylindrical ends only in a circle of 30 mm in inside diameter. It is put on a horizontal plane, with the opening upward perpendicularly. A sample of 20 $cm^3$ is put in this container, and the upper opening end is closed, and it is let stand for 24 hours at 20° C. Then the upper end is opened in the initial state, and the container is inclined by 90 degrees, and when the content flows within 1 minute to reach the opening of this glass container, it is defined to be flowable.

EXAMPLES

Examples 1 to 8, and Comparative Examples 1 to 3

Liquid detergent compositions shown in Table 1 were prepared in the following method, and in the obtained compositions and component (b) used in preparation of each composition, the electric conductivity ratio, ease of use (viscosity, spinnability), ordinary cleaning power, and application cleaning power were evaluated. Results are shown in Table 1.

[Preparation of Liquid Detergent Composition]

Each liquid detergent composition shown in Table 1 was prepared by weighing and blending each blending component at the ratio to 100 g of the liquid detergent composition. The specific manufacturing method is as follows.

(1) Preparation of Examples 1 to 8

Specified amounts of all components (c) were weighed and put in a100 mL beaker, and mixed at ordinary temperature. Specified amounts of polymer type dispersant (freeze-dried product) and fluorescent whitening agent were added, and heated for 5 hours at 50° C. This mixture was cooled gradually in air to ordinary temperature, and a specified amount of component (a) was added and mixed, and a liquid mixture was obtained. Specified amounts of all components (b) and specified amounts of all components (d) were added, and mixed lightly, then by using a batch type sand mill (capacity 1 L, Aimex) filled with 500 g of zirconia beads of 0.5 mm in diameter, the mixture was ground for 1 hour at disk rotating speed of 1500 r/min (while circulating 15° C. water in a jacket type cooler). The obtained liquid-solid mixture was passed through 40-mesh sieve, and zirconia beads were removed. Further, an enzyme (liquid) was added, and the mixture was stirred and mixed at ordinary temperature, and liquid detergent compositions of Examples 1 to 8 were obtained.

(2) Preparation of Comparative Examples 1 to 3

Specified amounts of all components (c) were weighed and put in a 100 mL beaker, and mixed at ordinary temperature. Specified amounts of component (a) and fluorescent whitening agent were added to this mixture, and mixed and a liquid mixture was obtained. Specified amounts of all components (b) and specified amounts of all components (d) were added, and mixed lightly, then by using a batch type sand mill (capacity 1 L, Aimex) filled with 500 g of zirconia beads of 0.5 mm in diameter, the mixture was ground for 1 hour at disk rotating speed of 1500 rpm (while circulating 15° C. water in a jacket type cooler). The obtained liquid-solid mixture was passed through 40-mesh sieve, and zirconia beads were removed. Further, an enzyme (liquid) was added, and the mixture was stirred and mixed at ordinary temperature, and liquid detergent compositions of Comparative Examples 1 to 3 were obtained.

[Evaluation of Electric Conductivity Ratio]

(1) Measurement of Electric Conductivity σ1 of Liquid Detergent Composition

From each liquid detergent composition in Table 1 obtained in the above method, 80 g was sampled and put in a 100 mL wide-mouthed standard bottle PS No. 11, and the bottle was covered with a lid and placed still in a 25° C. thermostatic room for 1 hour before measurement. Using electric conductivity meter CM-60S of DKK-TOA Corporation, electric conductivity electrode CG511B (cell constant 0.986) and temperature reference electrode TH1005B were immersed in the sample, and the sample temperature was confirmed to be 25° C. by checking the temperature reference electrode, and the value of the electric conductivity (S/cm) was read, and σ1 of the sample was obtained.

(2) Measurement of Electric Conductivity σ2 of component (b)

From each liquid detergent composition of Examples 1 to 8 and Comparative Examples 1 and 2, a mixture of all water-soluble inorganic salts (including all components (b)) was prepared at a ratio per 100 g of the composition. In each water-soluble inorganic salt mixture, distilled water was added to adjust the concentration of the mixture to 3.22 mass %, and a sample aqueous solution was prepared. In Comparative Example 3, a mixture containing all water-soluble inorganic salts (including all components (b)) was weighed at a ratio per 1000 g of the composition, and distilled water (Katayama Chemical, Inc.) was added to adjust the concentration of the mixture to 3.22 mass %, and a sample aqueous solution was prepared. Each sample aqueous solution was sampled in part (80 mL), and put in a 100 mL wide-mouthed standard bottle PS No. 11, and the bottle was covered with a lid and placed still in a 25° C. thermostatic room for 1 hour before measurement. The electric conductivity (S/cm) at 25° C. was measured same as mentioned above, and σ2 of the sample aqueous solution was obtained. (3) From the obtained values of σ1 and σ2, the value of σ2÷σ1 was calculated, and the electric conductivity ratio σ2/σ1 was determined.

[Evaluation of Ease of Use]

Putting 80 mL of each composition in a 100 mL measuring cylinder, it was let stand in a 25° C. thermostatic room, and the ease of use was evaluated in the following standard by ten panelers by pouring 40 mL of each composition (about half volume) into a washing machine (Toshiba Galaxy 3.6 model VH-360S1) containing 35 L of tap water.

Easy to pour liquid, and easy to adjust pouring liquid volume (3 points).

Easy to pour liquid, but hard to adjust pouring liquid volume (2 points).

Hard to pour liquid, but easy to adjust pouring liquid volume (2 points)

Hard to pour liquid, and hard to adjust pouring liquid volume (1 point).

The average of ten panelers was calculated, and the ease of use of the composition was evaluated and determined as follows.

◎: Average 2.8 or more to 3.

○: Average 2.5 or more to less than 2.8.

Δ: Average 2 or more to less than 2.5.

X: Average 1 or more to less than 2.

[Evaluation of Ordinary Cleaning Power and Application Cleaning Power]

(1) Preparation of Collar Soil Test Piece

The collar was cut off and collected from cotton/polyester blend shirt worn for three days, and divided into five groups depending on the degree of soil, and the second dirtiest collar section was presented for cleaning test.

(2) Cleaning Condition (2-1) Ordinary Cleaning Condition

In a washing tank of twin tank washing machine (Toshiba Galaxy 3.6 model VH-360S1), 40 L of tap water was poured in, and 1.4 kg of cotton unworn undershirt and 0.6 kg of cotton/polyester blend unworn shirt were immersed. Five collar pieces for evaluation were sewn to a cotton cloth of 30 cm×30 cm, and the cloth was put in the washing tank, and 26.7 mL of the liquid detergent composition in Table 1 was poured in, and ordinary washing was conducted for 10 minutes. After dewatering for 1 minute, the wash was rinsed in running water for 8 minutes at a rate of 15 L/min. Then the wash was dewatered for 5 minutes and dried naturally in room.

(Preparation of Ordinary Cleaning Power Test Reference Sample)

Instead of the liquid detergent compositions in Table 1, as reference detergent, JIS powder detergent (index detergent for judging cleaning power mentioned in JIS K 3362-1998) was used by the standard amount, and collar pieces were washed similarly and dried naturally in room.

(2—2) Application Cleaning Condition

In a washing tank of twin tank washing machine (Toshiba Galaxy 3.6 model VH-360S1), 40 L of tap water was poured in, and 1.4 kg of cotton unworn undershirt and 0.6 kg of cotton/polyester blend unworn shirt were immersed. Five collar pieces for evaluation were sewn to a cotton cloth of 30 cm×30 cm, and the liquid detergent composition in Table 1 was directly applied to the cloth, by 3 mL each to each collar piece (total 15 mL), and the cloth was put in the washing tank, and further 11.7 mL of the liquid detergent composition in Table 1 was poured in the washing tunk, and ordinary washing was conducted for 10 minutes. After dewatering for 1 minute, the wash was rinsed in running water for 8 minutes at a rate of 15 L/min. Then the wash was dewatered for 5 minutes and dried naturally in room.

(Preparation of Application Cleaning Power Test Reference Sample)

Instead of the liquid detergent compositions in Table 1, as reference detergent, a commercial liquid detergent (Liquid Attack of Kao Corporation) was used, and collar pieces were washed similarly and dried naturally in room.

(3) Criterion of Cleaning Power

In the ordinary cleaning condition and application cleaning condition, the collar soil cleaning power was judged by one skilled paneler in the following standard.

◎: Soil is removed more than in reference sample.

○: Soil is removed in a similar degree compared to reference sample.

Δ: Soil is removed less than in reference sample.

X: Soil is clearly not removed as compared with reference sample.

The reliability of the result judged by one skilled paneler was verified by Scheffe's paired comparison method by ten panelers. That is, of each set of collar soil test pieces (one set comprising five pieces) judged by one skilled paneler, pairs of test pieces of adjacent results such as ◎ and ○, ○ and Δ, and Δ and X were verified by other ten panelers by Scheffe's paired comparison method, and the judging result by one skilled paneler was judged to have a significant difference at confidence limit of 95%.

TABLE 1

| | Examples | | | | | | | | Comparative examples | | |
|---|---|---|---|---|---|---|---|---|---|---|---|
| Liquid detergent composition | 1 | 2 | 3 | 4 | 5 | 6 | 7 | 8 | 1 | 2 | 3 |
| Blended component (mass %) | | | | | | | | | | | |
| (a) Distilled water | 4 | 4 | 8 | 6 | 10 | 4 | 8 | 5 | 1 | 25 | 50 |
| (b) Sodium carbonate | 15 | 10 | 10 | 5 | 5 | | 5 | | 10 | | |
| Potassium carbonate | | 5 | | | | | | | | | |
| Sodium hydrogencarbonate | | | 10 | | | | | | | | |
| Sodium silicate(1) | | | | | | 10 | | | | | |
| Sodium tripolyphosphate | | | | | | | 10 | 25 | | 35 | |
| Sodium sulfite | 0.5 | 0.5 | 0.5 | 0.5 | 0.5 | 0.5 | 0.5 | 0.5 | 0.5 | 0.5 | 0.5 |
| (c) Propylene glycol | 10 | 15 | 5 | 15 | | 20 | | | 15 | 5 | 3 |
| Butyl carbitol | | 5 | 5 | | 5 | | 20 | 10 | 5 | | |
| Phenol with EO 3 mole addition | 15 | 5 | 15 | 10 | 20 | 20 | | 10 | | 5 | |
| Pentylglycerylether | | | 5 | 10 | | | 10 | 5 | | | |
| Monoethanolamine | | | | | | | | | | | 3 |
| Nonionic surface active agent A | 20 | | 10 | 10 | 18 | | | 30 | 15 | | |
| Nonionic surface active agent B | | 18 | | 2 | | 16 | 20 | | 20 | | 5 |
| Nonionic surface active agent C | | | 3 | 8 | | 1 | 3 | | | 10 | |
| Lauryldimethylamine oxide | 1 | 2 | | | | | | 1 | 1.5 | | |
| Anionic surface active agent A | | | 0.5 | 4 | | | 0.5 | 0.5 | | 10 | 12 |
| Anionic surface active agent B | | 1.5 | | 1 | 2 | | | 0.5 | | 3 | |
| Fatty acid | 1 | 1 | 1 | 1 | 1 | 1 | 1 | 1 | 1 | 0.5 | 0.5 |
| (d) Zeolite 4A | 30 | | 24 | | 35 | 20 | 20 | | 30 | 5 | |
| Cristalline silicate | | | | 20 | | 5 | | | | | 5 |
| Zeolite P | | 30 | | 5 | | | | 10 | | | 20 |
| Polymer type dispersant | 2.5 | 2 | 2 | 1.5 | 2.5 | 1.5 | 1 | 0.5 | | | |
| Enzyme | 0.5 | 0.5 | 0.5 | 0.5 | 0.5 | 0.5 | 0.5 | 0.5 | 0.5 | 0.5 | 0.5 |
| Phosphor paint | 0.5 | 0.5 | 0.5 | 0.5 | 0.5 | 0.5 | 0.5 | 0.5 | 0.5 | 0.5 | 0.5 |
| Electric conductivity ratio σ2/σ1 | 50 or more | 51 or more | 52 or more | 53 or more | 54 or more | 55 or more | 56 or more | 57 or more | 58 or more | Less than 10 | Less than 10 |
| Ease of use | ○ | ○ | ◎ | ◎ | ○ | ○ | ◎ | ◎ | Δ | X | Δ |

TABLE 1-continued

| | Examples | | | | | | | | Comparative examples | | |
|---|---|---|---|---|---|---|---|---|---|---|---|
| Liquid detergent composition | 1 | 2 | 3 | 4 | 5 | 6 | 7 | 8 | 1 | 2 | 3 |
| Ordinary cleaning power (collar soil) | ◎ | ◎ | ◎ | ○ | ○ | ○ | ○ | ○ | ○ | ○ | Δ |
| Application cleaning power (collar soil) | ◎ | ○ | ◎ | ◎ | ◎ | ◎ | ○ | ◎ | X | Δ | X |

(Note)
Components in Table 1 are shown below.
Distilled water: Katayama Chemical, Inc. (20 L).
Sodium silicate (1): Powder soda silicate No. 1.
Butylcarbitol: Diethyleneglycol monobutylether.
Phenol with EO 3 mole adduct: Polyoxyethylene monophenyl ether (with addition of average 3 moles of EO).
Pentylglycerylether: n-pentylmonoglycerylether.
Nonionic surfactant A: Straight chain primary alcohol with 10 to 14 carbon atoms, with block addition of average of 3 moles of EO, average of 2 moles of PO, and average of 3 moles of EO in this sequence.
Nonionic surfactant B: Straight chain secondary alcohol with 12 to 14 carbon atoms, with addition of average of 7 moles of EO (Softanol 70 of Nippon Shokubai Co., Ltd.).
Nonionic surfactant C: Compound in formula (4), where $R^4$ is branched chain primary alkyl group with 9 to 11 carbon atoms, x = 0, y = 1.3, and G is glucose residue.
Anionic surfactant A: Linear alkylbenzene sulfonate sodium salt with 10 to 14 alkyl carbon atoms (average molecular weight 345).
Anionic surfactant B: Alkylethoxy sulfate sodium salt with 12.2 carbon atoms in average, having average of 3 moles of EO added per molecule to branched chain primary alcohol.
Fatty acid: Palm oil fatty acid with 12 to 16 carbon atoms (Lunac L-55 of Kao Corporation).
Zeolite 4A: Type 4A zeolite (Toyo Builder of Tosoh Corporation, containing 20 mass % of water of crystallization).
Crystalline silicate: Laminar sodium silicate (SKS-6 of Hoechst).
Zeolite P: Type P zeolite (Doucil A24 of Crossfield), containing 16 mass % of water of crystallization.
Polymer type dispersant: Freeze-dried product of Aqualock FC600S (Nippon Shokubai Co., Ltd.) (moisture determination by Karl Fischer: 1.3 mass %).
Enzyme: Everalase 16.0 L type EX (protease of Novozymes A/S).
Fluorescent whitening agent: Tinopal CBS-X (Ciba Specialty Chemicals).

What is claimed is:

1. A liquid detergent composition comprising (a) 3 to 15 mass % of water, (b) 0.5 to 50 mass % of a builder composed of a water-soluble inorganic salt of which solubility in distilled water is 0.5 g/15 g (25° C., distilled water) or more, and (c) 20 to 85 mass % of a substance liquid at 25° C. comprising at least one selected from the group consisting of a surfactant (c1) and a water-miscible organic solvent (c2), wherein part of (b) is present in solid state in the composition, and the following formula (1) is satisfied:

$$\sigma 2/\sigma 1 \geqq 10 \quad (1)$$

wherein σ1 is the electric conductivity (S/cm, 25° C.) of the liquid detergent composition, and σ2 is the electric conductivity (S/cm, 25° C.) of aqueous solution of which concentration of total water-soluble inorganic salt in the composition including (b) is 3.22 mass %, and wherein the viscosity (20° C.) of the liquid detergent composition is to 10 to 2500 mPa·s.

2. The liquid detergent composition of claim 1, wherein (b) is a water-soluble inorganic salt with the pH of an aqueous solution (25° C., electrode method) of 10 or more having 0.5 g of (b) dissolved in 15 g of distilled water.

3. The liquid detergent composition of claim 1 or 2, wherein (c) is polyalkyleneglycol alkylether.

4. The liquid detergent composition of claim 1, further comprising (d) 0.5 to 50 mass % of a builder composed of a water-insoluble compound, existing at least in part in a solid state in the composition.

5. The liquid detergent composition of claim 4, wherein (d) is aluminosilicate.

6. The liquid detergent composition of claim 1, wherein (b) existing in solid state is particles of a disperse-average particle size of 1 μm or less.

7. The liquid detergent composition of claim 1, further comprising a polymer type dispersant.

8. The liquid detergent composition of claim 7, wherein the polymer type dispersant is a polymer dispersant obtained by polymerizing one or more monomers selected respectively from the monomer group for composing a soluble or uniform disperse polymer in liquid phase of a composition, and the monomer group having a functional group having affinity in solid component in a composition.

9. The liquid detergent composition of claim 1, wherein the component (c) is the water-miscible organic solvent (c2).

* * * * *